US005205099A

United States Patent [19]

Grünhage et al.

[11] Patent Number: 5,205,099

[45] Date of Patent: Apr. 27, 1993

[54] FIRE-RETARDANT GLAZING

[75] Inventors: Holger Grünhage, Mainz; Roland Leroux, Elsheim; Jürgen Thürk, Schornsheim; Lothar Frenz, Mainz, all of Fed. Rep. of Germany

[73] Assignee: Schott Glaswerke, Mainz, Fed. Rep. of Germany

[21] Appl. No.: 618,242

[22] Filed: Nov. 27, 1990

[30] Foreign Application Priority Data

Nov. 27, 1989 [DE] Fed. Rep. of Germany ..... 3939149

[51] Int. Cl.[5] ..... E04B 1/94; E04B 2/88

[52] U.S. Cl. ..... 52/475; 52/397; 52/400

[58] Field of Search ..... 52/397, 398, 399, 400, 52/401, 773, 774, 775, 475

[56] References Cited

U.S. PATENT DOCUMENTS

| | | | |
|---|---|---|---|
| 2,205,538 | 6/1940 | Owen | 52/398 |
| 3,981,697 | 9/1976 | Buckthorpe | 52/400 |
| 4,266,383 | 5/1981 | Krueger et al. | 52/400 |
| 4,825,609 | 5/1989 | Rundo | 52/397 |

FOREIGN PATENT DOCUMENTS

| | | | |
|---|---|---|---|
| 650760 | 10/1962 | Canada | 52/398 |
| 0166330 | 6/1985 | European Pat. Off. . | |
| 1237287 | 9/1962 | Fed. Rep. of Germany . | |
| 3826260 | 3/1989 | Fed. Rep. of Germany . | |

*Primary Examiner*—David A. Scherbel
*Assistant Examiner*—Joanne C. Downs
*Attorney, Agent, or Firm*—Millen, White, Zelano & Branigan

[57] ABSTRACT

A fire-retardant glazing is disclosed wherein, especially in case of a fire, a wedge is displaced on a counter bevel in parallel to the pane by means of an intumescent material and thereby generates an extensively permanent contact pressure on the pane in the pane channel.

14 Claims, 5 Drawing Sheets

FIRE-RETARDANT GLAZING

Figure 1:
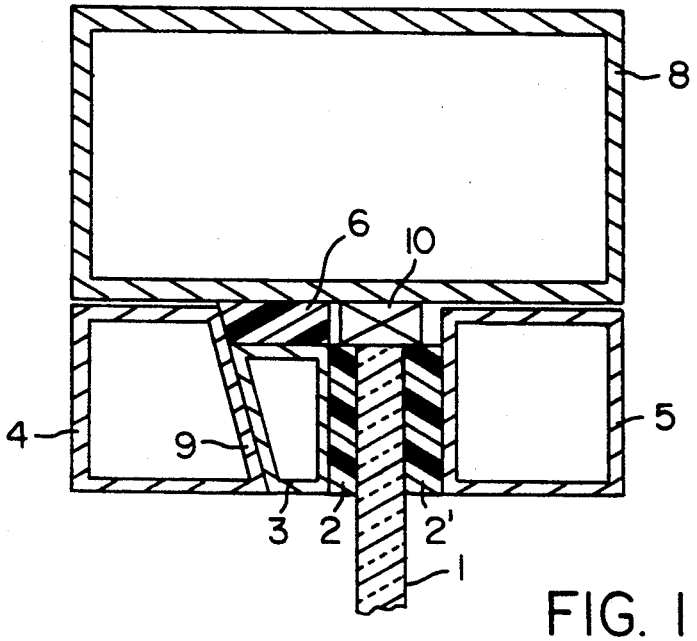

The invention relates to a fire-retardant glazing consisting of a frame and/or facing profiles acting as a frame, wherein at least one pane with associated gaskets and, respectively, spacer strips of an inorganic or organic material is clamped in place by way of at least one glass mounting strip arranged at the rim.

Conventional panes of special glass utilized in fire-retardant glazings, for example prestressed borosilicate glasses, do not break in case of a fire but rather become soft and, on account of their weight, can slip as a deformed mass out of the mounting or frame. The laminated glasses which are likewise used in fire-retardant glazings do break but are held together, for example, by a wire insert or an intermediate layer (e.g. alkali silicates, aqueous gels) and thus can still perform their fire protection function. However, they will likewise soften and can then slip out of the frame. The fire-retardant function, though, can only be fulfilled if the aforementioned panes are securely retained in the frame.

Therefore, in order to attain longer fire-resistive periods, fire-retardant glazings have been developed wherein the frame systems prevent slipping of the panes out of the frame.

It is known from DOS 3,826,260 to clamp the rims of the panes in place by means of clamping strips which latter are under spring pretension. The spring pretension is produced by leaf, plate or coil springs. This structure is relatively expensive, must be mounted very carefully (danger of breakage and/or lack of meeting the fire-retardancy function), and moreover has the drawback that springs can lose their tensional force under the effect of heat (they are soft-annealed) and thereby lose their effectiveness. It has also been known, for example, from DOS 3,423,298, DOS 3,426,236 or DOS 3,621,943 to produce an additional contact pressure only in case of a fire by the use of heat-activated springs or intumescent materials arranged between the pane and the frame. Springs exhibit the aforedescribed disadvantage that they can be soft-annealed. Intumescent materials are economical and simple in their use. They expand with gas formation; however, the pressure-producing gases have the tendency of volatilization so that the contact pressure fades again already after a brief period of time, or even becomes entirely ineffective.

The object of the invention resides in finding a fire-retardant glazing which can be manufactured and mounted in a simple and economical fashion, wherein especially an additional contact pressure is produced only in case of a fire, and wherein the contact pressure and the instant of exerting the contact pressure can be varied in a simple way so that the pressure is effective, in particular, at the time the pane has softened and threatens to slip out, and wherein the contact pressure still remains effective, above all, even in case of a longer-lasting fire.

This object has been attained by the fire-retardant glazing described in claim 1.

The wedges represent movable glass mounting strips (swiggle strips) retaining the pane within the frame in case of a fire. The force acting on the driving surface of a wedge takes care of movably readjusting the wedge in case of a change in the dimension of the pane, of the frame, or of the channel gaskets at the clamping site and thus an adequate clamping force will at all times be available, preventing the slipping out of the pane from the frame.

The force acting on the driving surface of the wedge can be a permanently acting one, for example a spring, a pneumatic spring, or an organic spring element. With these spring elements, a suitable arrangement and thermal insulation must ensure that the spring action, in case of a fire, is not lost, or is lost only at a very late point in time. However, it is also possible and normally preferred to produce this force only in case of a fire. The special advantage of this solution resides in that the rim of the pane is tightly clamped in place only when a fire occurs, i.e. when the pane no longer has any inherent stability or, alternatively, in case the frame or the channel gaskets change their dimensions. All materials which produce a force upon heating are suitable as the media for generating the force in case of a fire. Especially suited are agents which expand upon heating, especially the conventional materials which generally become effective by water (steam) release or by gas release, such as vermiculites, zeolites, perlites, mica, but also alkali salts, boric acid, borate, silicic acid, or compounds which contain aluminum hydroxide, such as they are disclosed, for example, in EP OS 222,298. Also suitable in this connection are pyrolytic materials decomposing under the effect of heat (e.g. bloated graphites, carbonates, aluminum silicates, etc.), and mixtures of the above-mentioned materials.

For producing the force, it is also possible to utilize bimetallic springs, memory metals, or pneumatic springs wherein the gas is released only in case of a fire.

Sometimes a combination of both force effects is also advantageous, i.e. the wedge is prestressed by a permanent spring element and, in case of a fire, the permanent force acting on the driving surface is enhanced or replaced by a heat-activated force (intumescent composition, etc.).

The wedge is urged upwards along a counter bevel (guide surface) and translates the force acting on the driving surface into a forward and lateral movement wherein the lateral movement serves for pressing the pane rim against the frame of the glazing. The angle formed by the counter bevel with the surface of the pane is suitably dimensioned so that one wedge surface extends in parallel to the pane surface and that the other wedge surface is in fully flat contact with the counter bevel. However, it is not absolutely necessary for the sliding surfaces to move against each other in a completely congruent fashion. Reduction of the contact surface (sliding surface) to a small number of points has the advantage of lower slip resistance. As a result, the required pressure force on the driving surface is lower.

By selecting the wedge angle, the extent of sideward movement as related to the forward movement of the wedge can be fixedly determined or, in other words, the pressure with which the pane is urged against the frame at a specific pressure on the driving surface of the wedge. The wedge angle is suitably chosen so that a possible sliding back of the wedge upon easing of the pressure on the driving surface of the wedge is prevented by the existing static friction. This angle is dependent on the materials utilized for the sliding surfaces, especially on the static friction coefficient of the paired sliding surface. Angles of $<45°$ are used preferably in case of the frame with sliding surfaces of metal which is utilized with preference. However, the angle can be greatly increased by the use of materials with a higher static friction or of a detent mechanism. The reinforcing effect of the wedge (ratio of pressure on the driving surface of the wedge to the lateral contact pressure against the pane, exerted by the wedge) can be varied by the angle. A small angle means great force enhancement; a large angle represents small force enhancement. Angles of between 5° and 17° are especially advantageous.

The wedge is preferably designed as a metallic hollow profile member, on the one hand, because this results in weight reduction and, on the other hand, because the walls of a hollow wedge possess a certain inherent spring effect so that even after fading of the intumescent action a contact pressure against the pane is still maintained.

Materials having a temperature stability of at least about 700° C. are preferred to serve as the material for the wedge and the counter bevel. In general, steel or tubular steel profile will be used, but likewise suitable are sliding surfaces or solid profiles of ceramic, glass-ceramic, carbon, or temperature-resistant metal alloys.

The invention will be described further below with reference to the drawings showing, in schematic representation:

FIGS. 1–4: vertical sections through the frame of various glazings with wedges, the driving-in direction of which extends in the direction of the pane center.

Figure 5:
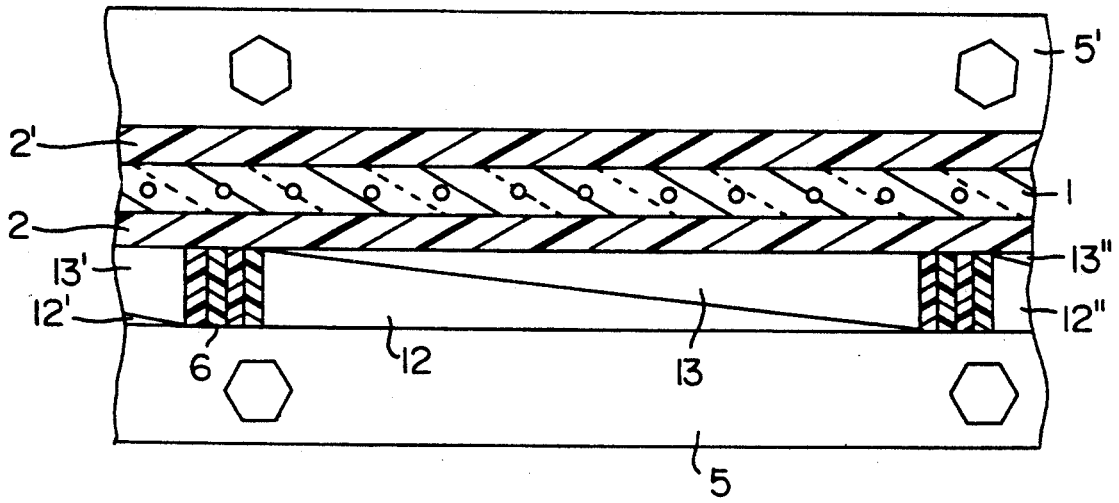

FIG. 5: a horizontal section through the marginal zone of a glazing with the driving-in direction of the wedges extending in parallel to the pane rim.

Figure 6:
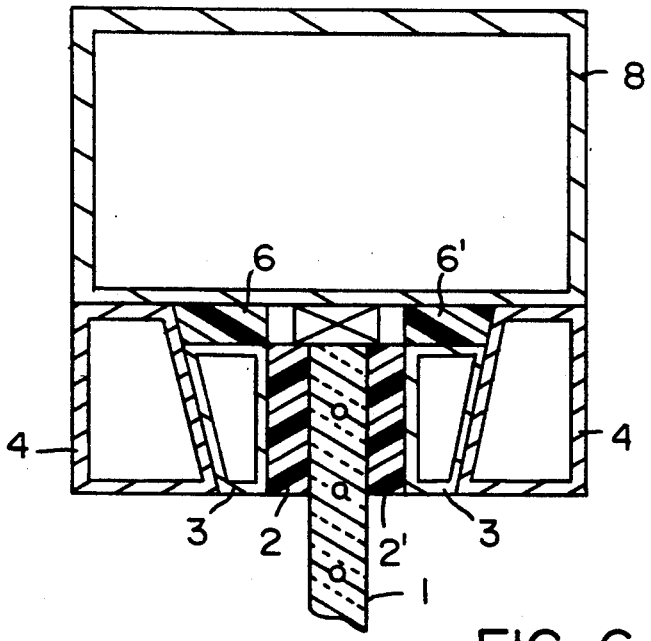

FIG. 6: a section through a glazing with 2 wedges.

Figure 7:
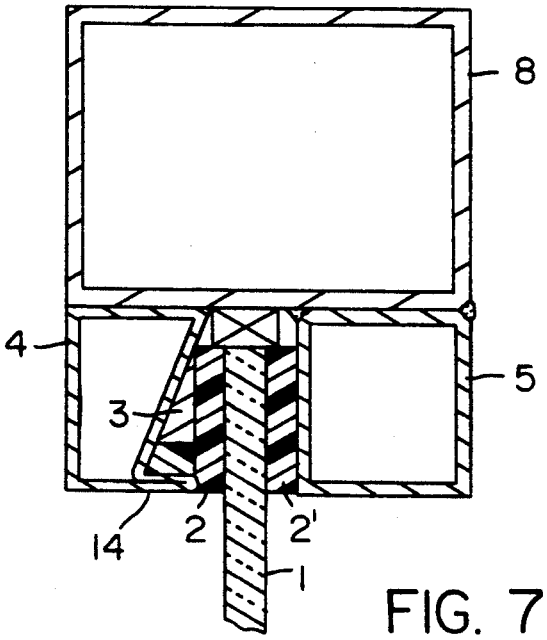

FIG. 7: a section through a glazing with the driving-in direction of the wedge being in the direction toward the bottom of the channel.

Figure 8:
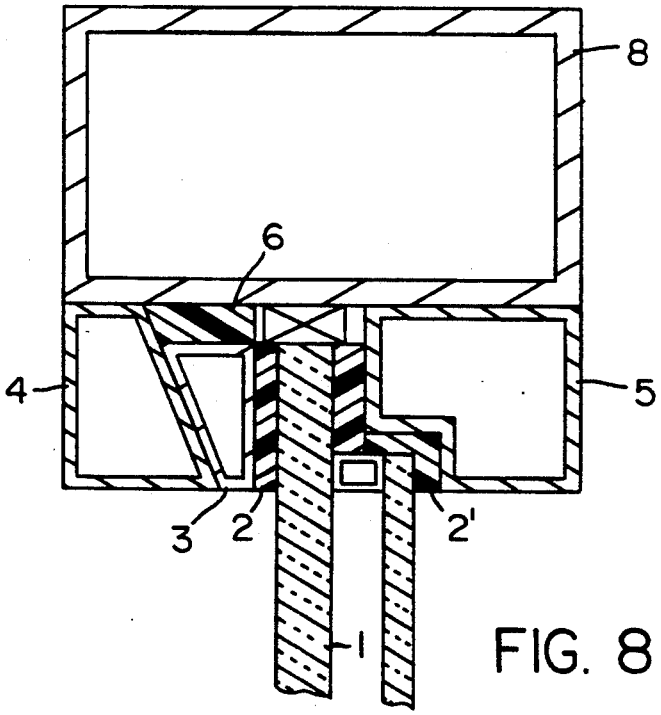
Figure 9:
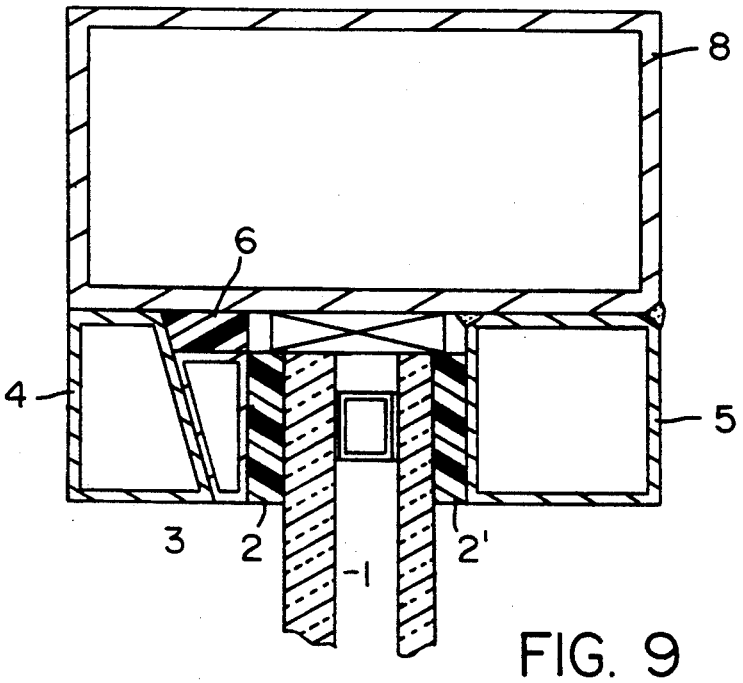

FIGS. 8 and 9: sections through the marginal zone of a glazing with various multiple-pane insulating glasses.

Figure 10:
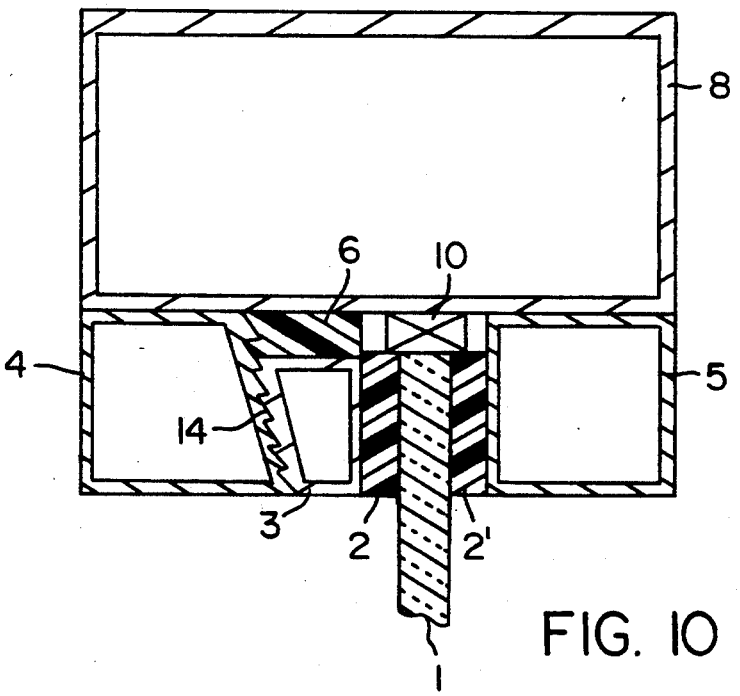

FIG. 10: a section through the marginal zone of a glazing wherein the sliding surfaces between the wedge and the counter bevel are provided with detents.

Figure 2:
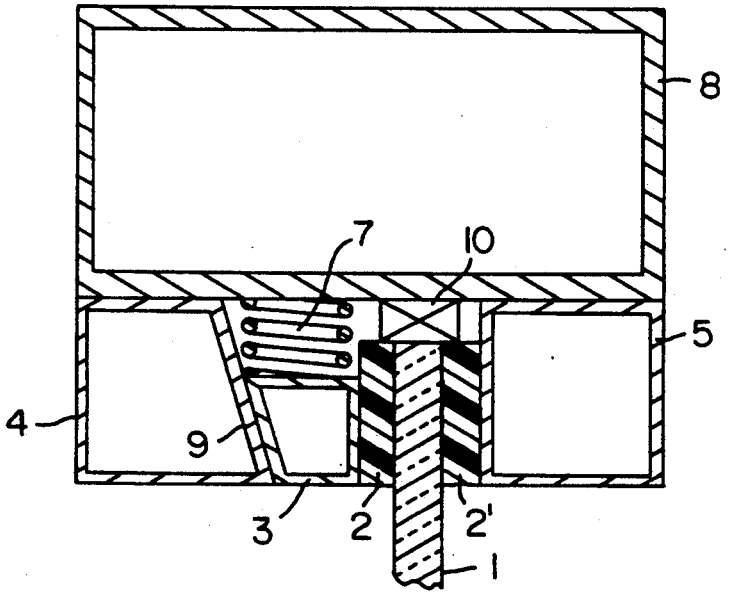

FIGS. 1 and 2 show a frame of a box-shaped basic profile member 8 equipped with two glass mounting strips 4 and 5, likewise consisting of box-shaped profile members. The glass mounting strip 4 is provided with a counter bevel 9 for the wedge 3 which latter is fashioned as a hollow profile member. The pane is retained in the frame by means of the wedge 3 in conjunction with the channel gaskets 2, 2' and the cleat 10. The sealing strips 2, 2' consist of a nonflammable or fire-resistive material and are to prevent direct contact of the frame with the pane 1 and, after assembly, are to ensure a firm seating of the pane on account of their elasticity. Below the wedge 3, an intumescent compound 6 is arranged in the bottom of the channel; this compound expands in case of a fire and displaces the wedge 3 along the counter bevel 9 in the direction toward the center of the pane and thus urges the wedge against the channel gasket 2 and the pane 1. The provision of the intumescent material 6 in the channel bottom has the advantage that there is no need for a separate abutment for the intumescent material 6, that, furthermore, the intumescent material is better protected against premature heating, and that the portion of the wedge pushed out of the channel in case of a fire shields the rim of the glass against the direct exposure to radiant heat and flames with the consequence of a lower temperature gradient in the marginal zone of the pane. The instant of expansion of the intumescent mass can also be affected by the thermal conductivity of the material of which the wedge is made and/or the wall thickness of the wedge. It is also possible to fill the cavity of the wedge, but also the cavity of the glass mounting strip 4, with a fire-retardant material. Fire-retardant materials can consist, for example, of cement, fireclay mortar, gel-like compositions with a high proportion of water, especially aqueous silicates, but also aqueous acrylates and polyacrylates. Such a feature is of advantage, in particular, in case the intumescent composition is to react at a late point in time. This is made possible by the increased thermal capacity of the wedge on account of the filling and/or by the heating power needed in case of a fire by the vaporization of the aqueous fire-retardant composition. With these measures, it is possible to avoid exceeding a predetermined temperature of the intumescent compound over a corresponding period of time.

Figure 3:
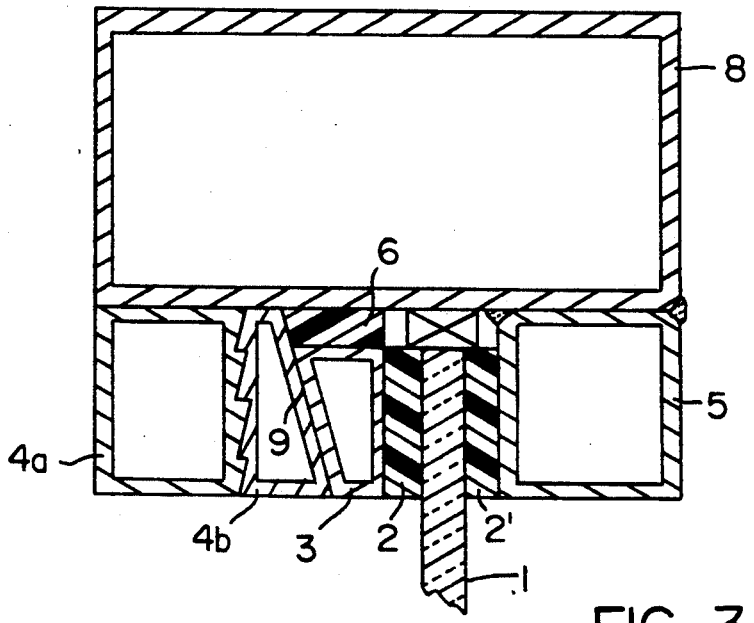

In FIG. 2, the wedge 3 is exposed to permanent pressure exerted by the spring 7. In this case the sealing strips 2 and 2' can also consist of an inelastic material. As soon as the pane becomes soft or the channel geometry is changing, the spring will advance the wedges. FIG. 3 shows an embodiment wherein the glass mounting strip is made of two partial sections **4*a* and 4*b* connected, for example interlocked, in a shape-mating fashion. By the use of differently wide partial sections 4*b*, the frame can be utilized without difficulties for differently thick panes. By inserting the partial section 4*b*** to differing depths in the frame, with a correspondingly fine interlocking action, the initial clamping pressure exerted on the pane can be varied; also, varying pane thicknesses can thereby be compensated for during assembly.

Figure 4:
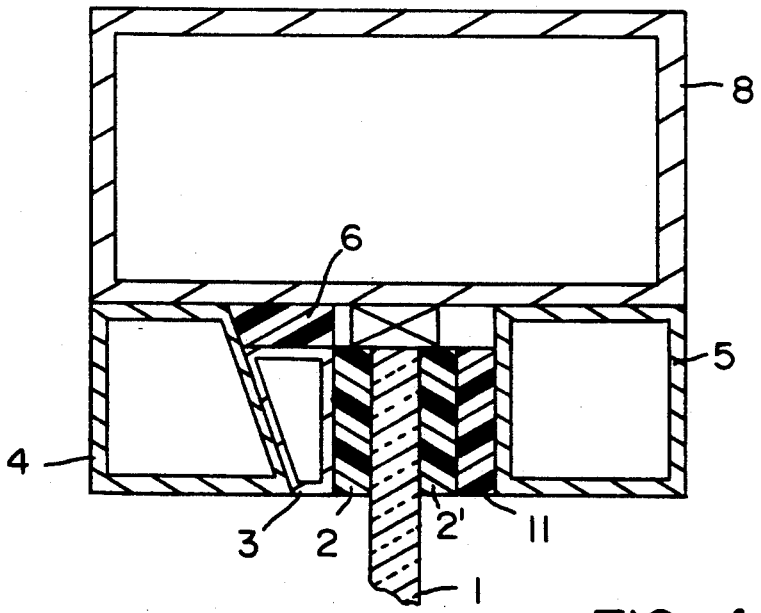

FIG. 4 illustrates the same pane structure as FIG. 1 except that, additionally to the intumescent material 6 acting on the wedge 3, still another intumescent material 11 is provided which acts laterally on the pane. The advantages accompanying this embodiment reside, above all, in that an initial contact pressure is produced at a very early point in time, and the wedge mechanism needs to be activated only at a very late point in time. This results in particularly stable glazings.

FIG. 5 shows a horizontal section of a glazing wherein the driving-in direction of the wedges is not oriented out of the channel (approximately toward the center of the pane) but rather extends in parallel to the frame (identical reference numerals as in FIGS. 1 through 4 denoting the same components). A number of wedges 12', 13'; 12, 13; 12'', 13'' is arranged in series in the channel of the frame, the intumescent compound 6 of the wedge 13 resting against the driving surfaces of the wedges 13 and 12''. The wedges or counter bevels 12, 12' and 12'' can be fixedly joined to the glass mounting strip 5, but they can also lie movably within the channel. In the embodiment according to FIG. 5, several wedges are required for each channel since generally the wedge cannot be made of such a length that it occupies the entire channel length. Although usage of the wedges makes assembly of the pane in the frame more difficult, advantages are also achieved thereby. The wedges, in this case, do not additionally shield the rim of the pane when they are displaced. This can be of importance for certain glasses in order to better withstand the thermally induced stresses.

FIG. 6 shows a symmetrically designed glazing with two wedges 3 and 3'. Such an arrangement is advantageous in case very high contact forces are needed. Furthermore, the wedge facing away from the fire will be urged against the glass with a time delay as regards the wedge that faces the fire, because the pressure medium on the side facing away from the fire is activated at a later point in time.

FIG. 7 shows an embodiment wherein the drive-in direction of the wedge 3 extends in a direction toward the bottom of the channel. In order for the intumescent material 6 to become effective, the clamping strip 4 is provided with a web 14 acting as an abutment and as a support for the expanding mass 6. In this embodiment, a quite especially early response of the intumescent material is ensured. FIGS. 8 and 9 show glazings with multiple-pane insulating glass wherein the wedge mechanism is fashioned analogously to FIG. 1.

FIG. 10 shows a glazing wherein a possible backsliding of the wedge is prevented by a mutual detent mechanism on the sliding surfaces of wedge and counter bevel. The detent arrangement is illustrated in a greatly enlarged view. Under practical conditions, a substantially finer interlocking system will be selected to obtain maximally small detent stages.

Besides the advantages already enumerated above, the benefits provided by the glazing reside, above all, in that a very secure fixation of the pane is attained in case of a fire, wherein the contact pressure on the pane rim in case of a fire can be adjusted in a controlled fashion within wide limits. All of the conventional panes can be clamped in place, particularly prestressed single panes, multiple-pane insulating glass and laminated glass panes with organic or inorganic intermediate layers which, in case of a fire, retard the penetration of heat to the side facing away from the fire by a physical or chemical reaction. Structure and properties of the panes suited for fire retardation are well known to a person skilled in the art.

We claim:

1. A fire-retardant glazing arrangement comprising:

a frame for supporting a pane of glass having opposite surfaces, the frame including a frame channel with depending first and second beams spaced from one another and having spaced opposed surfaces defining a channel therebetween with a first bevel in the channel extending at an acute angle with respect to the pane;

a pair of gaskets disposed between the opposed surfaces defining the channel and opposite surfaces of the pane;

movable wedge means disposed between one of the gaskets and the first bevel for exerting pressure against the one gasket to help hold the pane against the other gasket and thus clamp the pane in the channel between the opposed surfaces, the wedge means including a second bevel in engagement with and extending at an interface therewith at a wedge angle which is substantially parallel to the first bevel; and thermally sensitive biasing means disposed in the channel and urging the wedge means in a direction parallel to the surfaces of the pane upon the application of heat to provide a pressure medium which increases clamping forces on the pane upon the occurrence of fire.

2. The fire-retardant glazing arrangement of claim 1, wherein the wedge means comprises a plurality of wedges.

3. The fire-retardant glazing arrangement of claim 2, wherein the wedges are disposed horizontally in the channel with complementary bevelled surfaces in abutment with one another, the biasing means being disposed to expand horizontally.

4. The fire-retardant glazing arrangement of claim 3, wherein the wedges are arranged in pairs with the biasing means disposed between the pairs.

5. The fire-retardant glazing arrangement of claim 1, wherein the wedge means is urged by the biasing means away from the frame channel.

6. The fire-retardant glazing arrangement of claim 1, wherein the wedge means is urged by the biasing means toward the frame channel.

7. The fire-retardant glazing arrangement of claim 1, wherein the wedge means comprises a pair of wedges disposed on opposite sides of the pane.

8. The fire-retardant glazing arrangement according to claim 2, wherein the pressure medium is a material which expands when heated.

9. The fire-retardant glazing arrangement according to claim 8, wherein the pressure medium is a pyrolytic material.

10. The fire-retardant glazing arrangement according to claim 8, wherein the material selected from the group consisting of bloated graphite, vermiculite, zeolite, perlite, mica, and borax.

11. The fire-retardant glazing arrangement according to claim 8, wherein the moveable wedge means is fashioned as a hollow profile member.

12. The fire-retardant glazing arrangement according to claim 11, wherein the hollow profile member is filled with a fire-retardant composition selected from the group consisting of cement, fireclay mortar, aqueous silicates, and aqueous gels.

13. The fire-retardant glazing arrangement according to claim 8, wherein the wedge angle is between 5° and 17°.

14. The fire-retardant glazing arrangement according to claim 7, wherein the wedge angle is between 5° and 17°.

* * * * *